US005509646A

United States Patent [19]

Chang

[11] Patent Number: 5,509,646

[45] Date of Patent: Apr. 23, 1996

[54] MONEY BOX WITH AN ANTI-THEFT DEVICE

[75] Inventor: Yuan F. Chang, Taipei, Taiwan

[73] Assignee: Gamemax Corporation, Taipei, Taiwan

[21] Appl. No.: 240,456

[22] Filed: May 10, 1994

[51] Int. Cl.[6] ..... B65H 29/38

[52] U.S. Cl. ..... 271/177; 271/181

[58] Field of Search ..... 271/177, 180, 271/181, 220

[56] References Cited

U.S. PATENT DOCUMENTS 5,286,017 12/1994 Hawk et al. ..... 271/180 X

FOREIGN PATENT DOCUMENTS 9220892 11/1992 WIPO ..... 271/181

941493 7/1994 WIPO ..... 271/180

*Primary Examiner*—David H. Bollinger

*Attorney, Agent, or Firm*—Birch, Stewart, Kolasch & Birch

[57] ABSTRACT

A money box with an anti-theft device includes a motor gear housing, a paper money pressing lid and a paper money stacking case. The motor housing had a pair of racks disposed at both side walls of the housing. The bracket is locked to the motor housing. A driving plate is connected to the driving shaft of the motor. A sliding block is sleeved onto the driving shaft of the motor. A connecting plate is attached to the connecting socket through a screw. A positioning plate is riveted to the rear corners of the motor gear housing. A circular slot is disposed at the upper portion of the paper money pressing lid. A pressing shaft and a spring are installed within the circular slot. A screw is used to connect the paper money shaft to the money pressing plate. A positioning shaft is further used to pass through the through hole of the paper pressing lid. Then a pair of screws are used to lock it. It can be positioned with the positioning plate. A clipping plate is attached to the button of the connecting socket. Accordingly, the motor housing is connected to the money paper pressing lid firmly and neatly.

6 Claims, 6 Drawing Sheets

MONEY BOX WITH AN ANTI-THEFT DEVICE

BACKGROUND OF THE INVENTION

This invention relates to a money box, more particularly, to a money box with an anti-theft device. The paper money can be readily and smoothly received and stacked within the money box.

Current money boxes have various kind of stacking mechanism. Most of the stacking mechanism have a combination mechanism. The stacking mechanism is installed within the money box. If the stacking mechanism fails to work, the money box shall be disassembled, then the stacking mechanism is accessible for maintenance. This arrangement is really inconvenient and increases labor cost. On the other hand, the assembling of a disassembled money box takes a lot of time as well.

On the other hand, the stacking mechanism has a large buck size, accordingly, the inner space of the money box is wasted. As a result, the layout inside the money box is inefficient

SUMMARY OF THE INVENTION

It is the object of this invention to provide a money box wherein the stacking mechanism and the space for stacking paper money are located in different position. Accordingly, the inconvenience and the labor time spent in repair and maintenance are reduced.

It is still the object of this invention to provide a money box wherein each of the elements are separated from each other to facilitate easy maintenance.

It is still the object of this invention to provide a money box wherein the opening of the money box shall be done through a key. Accordingly, the possibility of theft is decreased to a certain low level.

In order to achieve the objects set forth, the money box made according to this invention includes a motor housing having a pair of racks disposed at both side walls of the housing. The rack is received by a slot disposed at both sides of the bracket. A pair of screws are used to lock the bracket to the motor housing through the threaded hole of the side wall. On the other hand, a pair of screws are used to lock the motor to a supporting plate of the side wall. A driving plate is connected to the driving shaft of the motor. A sliding block is sleeved onto the driving shaft of the motor. The sliding block is further received by the slot of the motor housing. A connecting plate is attached to the connecting socket through a screw. Accordingly, it can be connected to the frontal configuration. A positioning plate is riveted to the rear corners of the motor gear housing. The positioning plate is clipped to the positioning shaft.

A circular slot is disposed at the upper portion of the paper money pressing lid. A pressing shaft and a spring are installed within the circular slot. A screw is used to connect the paper money shaft to the money pressing plate. A positioning shaft is further used to pass through the through hole of the paper pressing lid. Then a pair of screws are used to lock it. It can be positioned with the positioning plate. A clipping plate is attached to the button of the connecting socket. Accordingly, the motor housing is connected to the money paper pressing lid firmly and neatly.

A key is disposed at the money box lid. When the key turns left, the locking plate is inserted into the keyhole, and the money box lid is locked.

BRIEF DESCRIPTION OF THE DRAWINGS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The structural and operational characteristics of the present invention and its advantages as compared to the known state of the prior art will be better understood from the following description, relating to the attached drawings which show illustratively but not restrictively an example of a money box with an anti-theft device. In the drawings.

DETAILED DESCRIPTION OF A PREFERABLE EMBODIMENT

Figure 1:
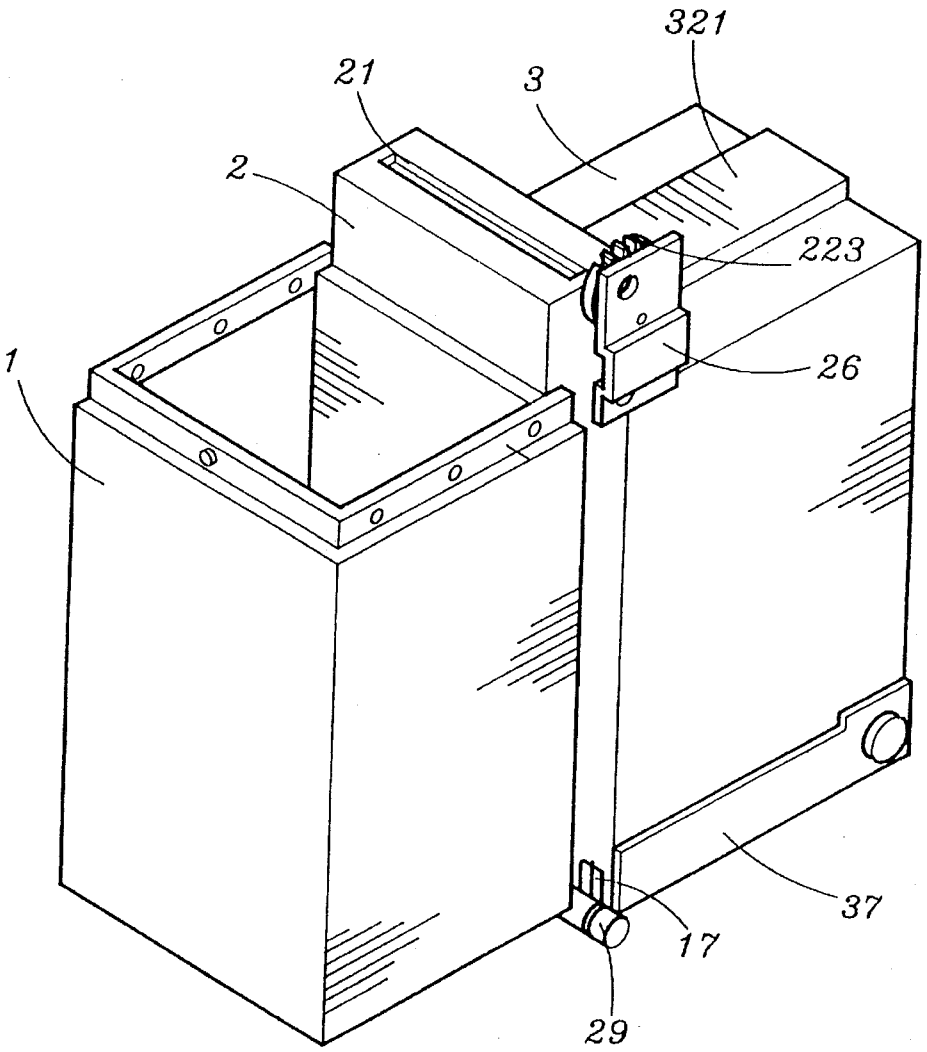
FIG. 1 is a perspective view of the money box made according to this invention.
Figure 2:
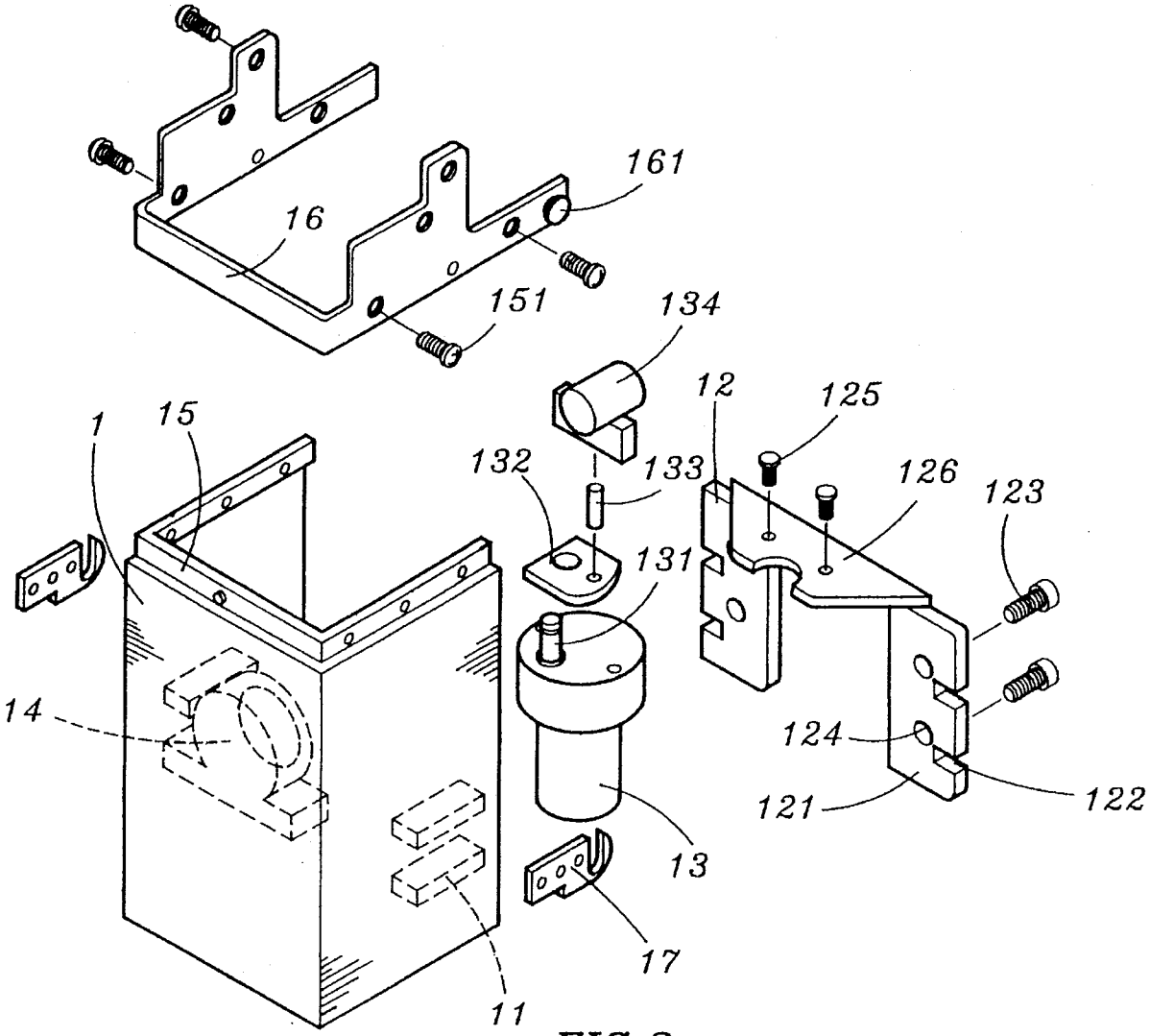
FIG. 2 is an exploded perspective view of a motor gear housing of the box made according to this invention.
Figure 3:
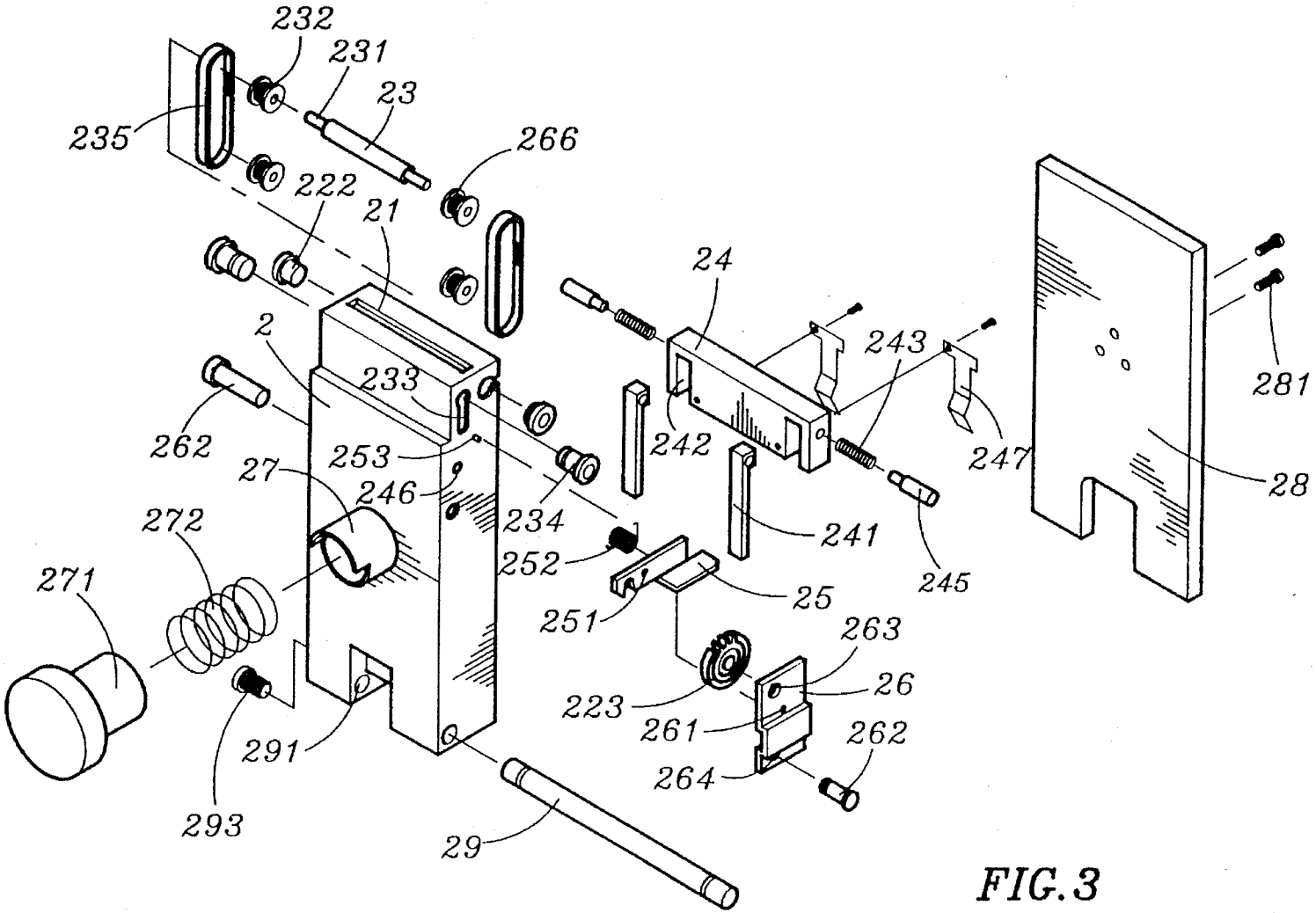
FIG. 3 is an exploded perspective view of a paper money pressing lid of the money box made according to this invention.
Figure 4:
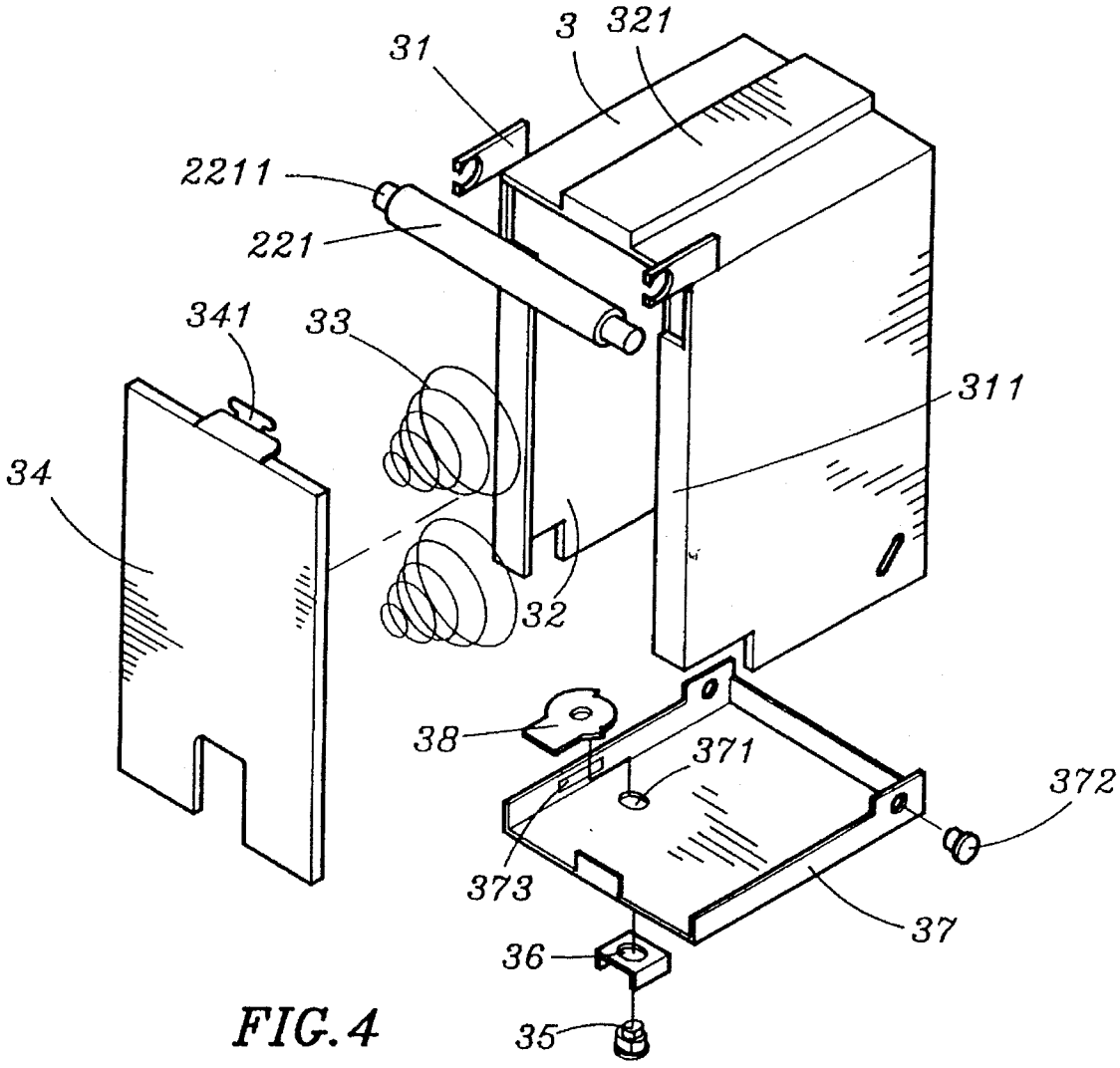
FIG. 4 is still an exploded perspective view of a paper money stacking case of the money box made according to this invention.

Referring to FIGS. 1, 2 and 3, specially to FIG. 1. The money box with an anti-theft device includes a motor gear housing 1, a paper money pressing lid 2 and a paper money stacking case 3. The motor housing 1 is incorporated with a pair of racks 11 at both sides. The rack 11 is received by a slot 122 disposed at both sides 121 of the bracket 12. A pair of screws 123 is used to lock the bracket 12 to the motor housing 1 through the threaded hole 124 of the side wall 121. On the other hand, a pair of screws 125 are used to lock the motor 13 to a supporting plate 126 of the side wall 121. A driving plate 132 is connected to the driving shaft 131 of the motor 13. A sliding block 134 is sleeved onto the driving shaft 133 of the motor 13. The sliding block 134 is further received by the slot 14 of the motor gear housing 1. A connecting plate 15 is attached to the connecting socket 16 through screws 151. Accordingly, it can be connected to the frontal configuration. A positioning plate 17 is riveted to the rear corners of the motor gear housing 1.

The positioning plate 17 is clipped to the positioning shaft 29.

A paper money pressing lid 2 is provided with a inlet 21 at a front end. A roller slot 22 is provided at both sides of the inlet 21. A roller 221 has a shaft end 2211 at both sides. A collar 222 is sleeved thereon. A gear 223 is provided at one of these two collars 222. It is received by the positioning hole 263 of the protecting plate 26. A roller 23 is provided with a pulley 232 at its shaft 231. It passes through the roller slot 233 disposed at the upper portion of the roller slot 22, accordingly, the collar 234 is sleeved on. A pair of posts 241 are used to press the front tip to the slot 242 of the positioning plate 24. Then a pair of coil springs 243 are inserted into the holes 244 of the positioning plate 24. A spring shaft 245 is inserted into the holes 244 of the positioning plate 24. Then the spring shaft 245 is inserted into the hole 246 of the paper money pressing plate 2. A spring 247 is locked to the positioning plate 24 to bias the post 241. The hole 251 and the spring 252 of the clipping plate 25 is sleeved onto the post 261 of the protecting plate 26. The protecting plate 26 seats evenly onto the sides of the paper pressing lid 2. A spring 252 is used to clip on the projected pin 253 of the paper pressing lid 2. A pair of pins 262 are inserted into the movable slot 265 of the money pressing lid 2. A pair of secondary rollers 266 are installed onto the pins 262. A belt 235 is used to bridge on the rollers 232 and secondary rollers 266. A circular slot 27 is disposed at the upper portion of the paper money pressing lid 2. A pressing shaft 271 and a spring 272 are installed within the circular slot 27. A screw 281 is used to connect the paper money shaft 271 to the money pressing plate 28. A positioning shaft 29 is further used to pass through the through hole 291 of the paper pressing lid 2. Then a pair of screws 293 is used to lock it. It can be positioned with the positioning plate 17. A clipping plate 25 is attached to the button 161 of the connecting socket 16. Accordingly, the motor housing 1 is connected to the money paper pressing lid 2 firmly and neatly.

The paper money stacking case 3 has a pair of symmetrical lugs 31 at a front side and a stopping plate 311 which is bent toward the slot 32 provided at the side walls of said lugs 31. A spring 33 and a paper bottom 34 are disposed at the slot 32. The guiding plate 341 of the bottom 34 is disposed into the sliding slot 321 of the slot 32. A key 35 is passing through the positioning slot 36 and the hole 371 of the box lid 37, then is in contact with the locking plate 38. The money box lid 37 and the paper money stacking case 3 are connected by a pair of screws 372. When the key 35 turns left, then the locking plate 38 is inserted into the keyhole 373 of the box lid 37 and, accordingly, the money lid 37 is locked.

Figure 5:
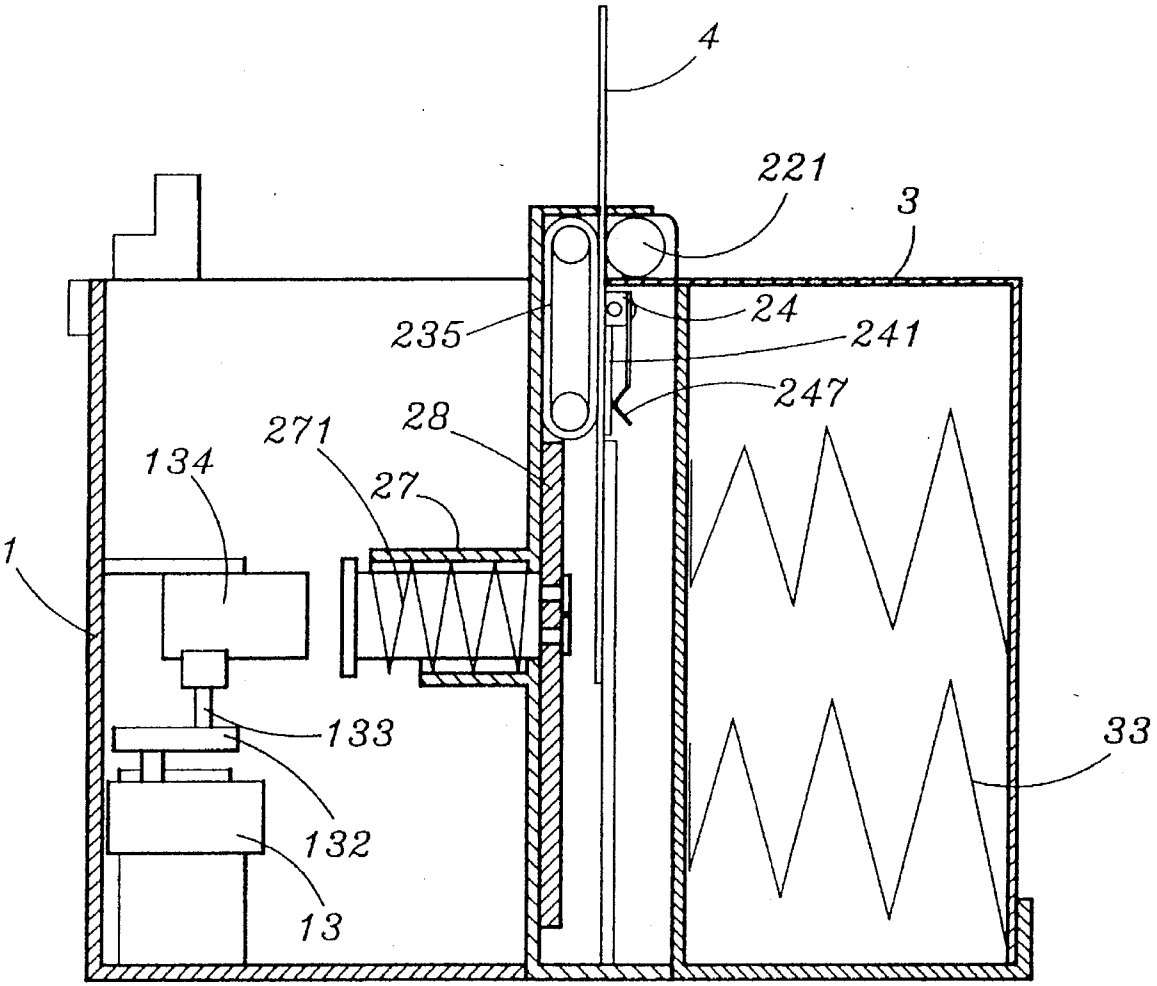
FIG. 5 is a side elevational view of the money box showing the operation of the money box.
Figure 6:
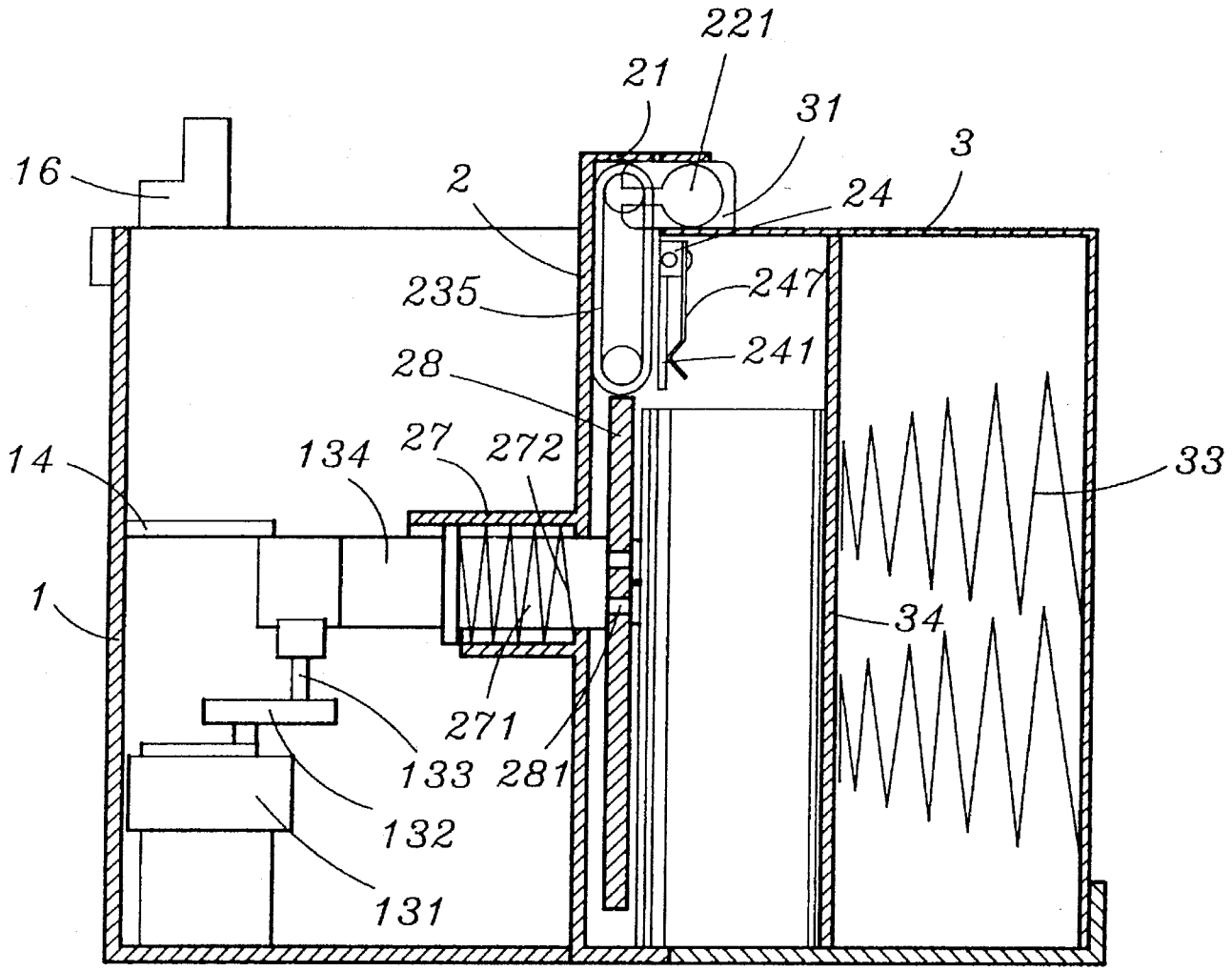
FIG. 6 is a cross sectional view of the money box showing the arrangement of the money box.

Referring to FIGS. 5 and 6, the view shows the operation of the money box. When the paper money 4 is inserted into the inlet 21 of the paper money pressing lid 2, the paper money 4 passes through the rollers 221 and 23. Then the paper money 4 is delivered to a position under the paper money pressing plate 28 through the belt 235 and the post 271. Then the pressing shaft 271 pushes against money paper plate 28, the paper money 4 is then sent to the paper money stacking case 3.

Although the present invention has been described in connection with preferred embodiments thereof, many other variations and modifications will now become apparent to those skilled in the art without departing from the scope of the invention. It is preferred, therefore, that the present invention not be limited by the specific disclosure herein, but only by the appended claims.

I claim:

1. A money box with an anti-theft device comprising:

a motor housing having a pair of side walls, a pair of racks being disposed on each side wall of the motor housing, a bracket with a pair of slots which are received in the racks on the side walls of the motor housing, the bracket being attached to the motor housing, a motor being mounted to the bracket, the motor having a driving shaft, a driving plate being connected to the driving shaft of the motor, a sliding block being sleeved onto the driving shaft of the motor, the sliding block being received in a slot formed in the motor housing, a connecting plate being on an edge of the motor housing, a connecting socket being attached to the connecting plate, a positioning plate being mounted to rear corners of the motor housing;

a money pressing lid, the money pressing lid having a positioning shaft on one end thereof, the positioning shaft being detachably mounted to the positioning plate of the motor housing, the positioning shaft passing through holes of the money pressing lid and being locked thereto by a pair of screws, the money pressing lid having a slot on one end thereof, a pressing shaft and spring extending through the slot of the money pressing lid, the money pressing plate being connected to the pressing shaft, a clipping plate being mounted between the money pressing lid and the connecting socket of the motor housing in order to detachably connect the money pressing lid and motor housing; and a money stacking case having a lid, the money stacking case being positioned adjacent the money pressing lid, a key being disposed in the money stacking case lid, the key being inserted through a keyhole in the money stacking case lid and being movable to lock and unlock the lid of the money stacking case.

2. The money box with anti-theft device as recited in claim 1, wherein said money stacking case has a pair of lugs on a front side thereof, a money receiving slot being formed in the money stacking case, stopping plates being provided adjacent the money receiving slot of the money stacking case, the stopping plates being formed from walls of the money stacking case which are bent towards the money receiving slot, the lugs being on the walls of the money stacking case with the stopping plates, a paper bottom and a spring being provided in the money stacking case, the paper bottom facing the money receiving slot and the spring being positioned between the paper bottom and a wall of the money stacking case, the paper bottom having a guiding plate and the money stacking case having a slot along which the guiding plate slides.

3. The money box with anti-theft device as recited in claim 2, further comprising a locking plate being provided in the money stacking case, the key being in contact with the locking plate to lock and unlock the lid of the money stacking case, the lid and the money stacking case being connected by a pair of screws, when the key is moved to unlock the lid of the money stacking case, the locking plate being inserted into the keyhole of the lid of the money stacking case.

4. The money box with anti-theft device as recited in claim 2, wherein the money pressing lid has an inlet at a front end thereof, a roller slot being provided at both sides of the inlet, a roller having a shaft with ends at both sides of the inlet, the roller being on the shaft and the shaft extending through the roller slot, a collar being sleeved on the shaft, a gear being provided at one of the ends of the shaft, a protecting plate being provided on the money pressing lid, the gear being received by a positioning hole of the protecting plate and a pulley being mounted on the roller shaft.

5. The money box with anti-theft device as recited in claim 2, further comprising a pair of posts and a money pressing lid positioning plate in the money pressing lid, the pair of posts pressing a front tip toward a slot of the money pressing lid positioning plate, a pair of coil springs being provided in holes in the positioning plate and a spring shaft being inserted into the holes of the positioning plate.

6. The money box with anti-theft device as recited in claim 2, further comprising a protecting plate provided on the money pressing lid, the clipping plate having a hole and spring which are sleeved onto a post of the protecting plate, the protecting plate seats evenly onto sides of the money pressing lid, the spring sleeved onto the post of the protecting plate clipping onto a pin projected from the money pressing lid, a pair of pins being inserted into a movable slot of the money pressing lid and a pair of secondary rollers being mounted on the pins, a belt bridging between the secondary rollers on the pins and rollers provided on the shaft of the roller of the money pressing lid.

* * * * *